US009090846B2

(12) United States Patent
Barton et al.

(10) Patent No.: US 9,090,846 B2
(45) Date of Patent: Jul. 28, 2015

(54) LUBRICATING COMPOSITION CONTAINING AN ANTIWEAR AGENT

(75) Inventors: William R. S. Barton, Belper (GB); Matthew D. Gieselman, Wickliffe, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 338 days.

(21) Appl. No.: 13/819,787

(22) PCT Filed: Aug. 24, 2011

(86) PCT No.: PCT/US2011/048886

§ 371 (c)(1), (2), (4) Date: Apr. 24, 2013

(87) PCT Pub. No.: WO2012/030590

PCT Pub. Date: Mar. 8, 2012

(65) Prior Publication Data

US 2013/0225461 A1 Aug. 29, 2013

Related U.S. Application Data

(60) Provisional application No. 61/378,428, filed on Aug. 31, 2010.

(51) Int. Cl.

| | |
|---|---|
| ***C10M 137/00*** | (2006.01) |
| ***C10M 159/12*** | (2006.01) |
| ***C10M 137/04*** | (2006.01) |
| ***C10M 137/08*** | (2006.01) |

(52) U.S. Cl.

CPC ..... *C10M 137/00* (2013.01); *C10M 137/04* (2013.01); *C10M 137/08* (2013.01); *C10M 159/123* (2013.01); *C10M 2207/026* (2013.01); *C10M 2207/282* (2013.01); *C10M 2215/04* (2013.01); *C10M 2215/064* (2013.01); *C10M 2215/28* (2013.01); *C10M 2219/046* (2013.01); *C10M 2223/04* (2013.01); *C10M 2223/043* (2013.01); *C10M 2223/045* (2013.01); *C10N 2230/06* (2013.01); *C10N 2230/56* (2013.01); *C10N 2240/04* (2013.01); *C10N 2240/044* (2013.01); *C10N 2240/045* (2013.01); *C10N 2240/08* (2013.01); *C10N 2240/10* (2013.01); *C10N 2240/101* (2013.01); *C10N 2240/102* (2013.01); *C10N 2240/104* (2013.01); *C10N 2240/105* (2013.01); *C10N 2240/12* (2013.01); *C10N 2240/14* (2013.01); *C10N 2240/30* (2013.01)

(58) Field of Classification Search

USPC ..... 508/428; 74/335

See application file for complete search history.

(56) References Cited

U.S. PATENT DOCUMENTS

| | | | | |
|---|---|---|---|---|
| 2,285,855 | A * | 6/1942 | Benning et al. | 508/441 |
| 2,396,345 | A | 3/1946 | Rogers et al. | |
| 2,631,132 | A | 3/1953 | McDermott | |
| 3,153,080 | A | 10/1964 | Caldwell | |
| 3,288,819 | A | 11/1966 | Tichelaar et al. | |
| 3,879,306 | A * | 4/1975 | Kablaoui et al. | 508/290 |
| 4,101,432 | A | 7/1978 | Okorodudu | |
| 4,157,970 | A | 6/1979 | Yaffe et al. | |
| 4,237,022 | A | 12/1980 | Barrer | |
| 4,436,640 | A * | 3/1984 | Yamaguchi | 508/369 |
| 4,863,622 | A | 9/1989 | Chiu | |
| 5,132,034 | A | 7/1992 | Hsu et al. | |
| 5,215,549 | A | 6/1993 | Hsu et al. | |
| 5,338,470 | A | 8/1994 | Hiebert et al. | |
| 6,127,327 | A | 10/2000 | Camenzind et al. | |
| 2002/0017629 | A1 | 2/2002 | Mosier et al. | |
| 2005/0198894 | A1 | 9/2005 | Migdal et al. | |
| 2010/0093573 | A1 | 4/2010 | Kocsis et al. | |
| 2010/0190669 | A1 | 7/2010 | Davies et al. | |
| 2010/0197536 | A1 | 8/2010 | Mosier et al. | |

FOREIGN PATENT DOCUMENTS

| | | |
|---|---|---|
| CA | 1183125 | 2/1985 |
| DE | 3304379 | 8/1984 |
| DE | 299533 A5 | 4/1992 |
| WO | 2005087904 | 9/2005 |
| WO | 2006044411 | 4/2006 |
| WO | 2008070307 | 6/2008 |

OTHER PUBLICATIONS

Written Opinion from corresponding International Application No. PCT/US2011/048886 dated Nov. 22, 2011.

Corresponding International Publication No. WO2012/030590 A1 and Search Report published Mar. 8, 2012.

Chemical Abstract Record for DE 3304379, Lottermoser, Aug. 9, 1984.

Chemical Abstract Record for DD 299533 A5, Buechner et al., Apr. 23, 1992.

Chemical Abstract Record for JP 2005139238A, Yanagi et al., Jun. 2, 2005.

Chemical Abstract Record for JP 1018316A, Imai Jul. 14, 1998.

Chemical Abstract Record for JP 051176800A, Sato et al., May 14, 1992.

Chemical Abstract Record for JP 10130679A, Endo et al., May 19, 1998.

* cited by examiner

*Primary Examiner* — James Goloboy

(74) *Attorney, Agent, or Firm* — Teresan W. Gilbert, Esq.; David M. Shold, Esq.

(57) ABSTRACT

The invention provides a lubricating composition containing an antiwear agent and an oil of lubricating viscosity. The invention further relates to the use of the lubricating composition in a mechanical device such as an internal combustion engine, or a driveline device.

15 Claims, No Drawings

LUBRICATING COMPOSITION CONTAINING AN ANTIWEAR AGENT

FIELD OF INVENTION

The invention provides a lubricating composition containing an antiwear agent and an oil of lubricating viscosity. The invention further relates to the use of the lubricating composition in a mechanical device such as an internal combustion engine, or a driveline device.

BACKGROUND OF THE INVENTION

It is well known for lubricating oils to contain a number of surface active additives (including antiwear agents, dispersants, or detergents) used to protect internal combustion engines from corrosion, wear, soot deposits and acid build up. Often, such surface active additives can have harmful effects on engine component wear (in both iron and aluminium based components), bearing corrosion or fuel economy. A common antiwear additive for engine lubricating oils is zinc dialkyldithiophosphate (ZDDP). It is believed that ZDDP antiwear additives protect the engine by forming a protective film on metal surfaces. ZDDP may also have a detrimental impact on fuel economy and efficiency and copper corrosion. Consequently, engine lubricants may also contain a friction modifier to obviate the detrimental impact of ZDDP on fuel economy and corrosion inhibitors to obviate the detrimental impact of ZDDP on copper corrosion. Other additives may also increase lead corrosion.

Further, engine lubricants containing phosphorus compounds and sulphur have been shown to contribute, in part, to particulate emissions and emissions of other pollutants. In addition, sulphur and phosphorus tend to poison the catalysts used in catalytic converters, resulting in a reduction in performance of said catalysts.

With increasing control of both the formation of sulphated ash and release of emissions (typically to reduce NOx formation, SOx formation) there is a desire towards reduced amounts of sulphur, phosphorus and sulphated ash in engine oils. Consequently, the amounts of phosphorus-containing antiwear agents such as ZDDP, overbased detergents such as calcium or magnesium sulphonates and phenates have been reduced. As a consequence, ashless additives such as esters of polyhydric alcohols or hydroxyl containing acids including glycerol monooleate and alkoxylated amines have been contemplated to provide friction performance. However there have been observations that ashless friction modifiers may in some instances increase corrosion of metal, namely, copper or lead. Copper and lead corrosion may be from bearings and other metal engine components derived from alloys using copper or lead. Consequently, there is a need to reduce the amount of corrosion caused by ashless additives.

Canadian Patent CA 1 183 125 discloses lubricants for gasoline engines containing alkyl-ester tartrates, where the sum of carbon atoms on the alkyl groups is at least 8. The tartrates are disclosed as antiwear agents. Other references disclosing tartrates and/or tartrimides include International Publication WO 2006/044411, and US Patent Applications 2010/0190669, 2010/0197536, and 2010/0093573 for internal combustion engines requiring reduced amounts of sulphur, sulphated ash, and phosphorus. The lubricant composition has anti-wear or anti-fatigue properties. The lubricating compositions are suitable for road vehicles.

U.S. Pat. No. 4,237,022 discloses tartrimides useful as additives in lubricants and fuels for effective reduction in squeal and friction as well as improvement in fuel economy.

U.S. Pat. No. 5,338,470 and International Publication WO 2005/087904 disclose lubricants containing at least one hydroxycarboxylic acid ester or hydroxy polycarboxylic acid (in particular citrates or ethyl glycolate). The lubricant composition has anti-wear or anti-fatigue properties.

International Application WO2008/070307 discloses engine lubricants containing antiwear agents based on malonate esters.

Citrates are disclosed in US Patent Application 20050198894.

U.S. Pat. No. 4,436,640 discloses a lubricant antiwear agent prepared by a two step reaction involving (i) reacting glycolic acid with an alcohol containing 1 to 6 carbon atoms, and (ii) reacting the product of (i) with phosphorus pentasulphide. The antiwear agent is reported to be useful for a camfollower set.

Lubricants additives derived from thioglycolic acid derivatives have been contemplated as additives. Additives from thioglycolic acid derivatives are summarised in a variety of U.S. Patents, Japanese patent application and an East German Patent. The U.S. Patents include U.S. Pat. Nos. 4,157,970, 4,863,622, 5,132,034, 5,215,549, and 6,127,327. The Japanese Patent Applications include 2005139238 A, Japanese Patent Applications 10183161A, 10130679A, and 05117680A. The East German Patent is DD 299533 A5.

For driveline power transmitting devices such as gears or transmissions, especially axle fluids and manual transmission fluids (MTFs), there are highly challenging technological problems and solutions for satisfying the multiple and often conflicting lubricating requirements, whilst providing durability and cleanliness. One of the important parameters influencing durability is the effectiveness of phosphorus antiwear or extreme pressure additives at providing devices with appropriate protection under various conditions of load and speed. However, many of the phosphorus antiwear or extreme pressure additives contain sulphur. Due to increasing environmental concerns, the presence of sulphur in antiwear or extreme pressure additives is becoming less desirable. In addition, many of the sulphur-containing antiwear or extreme pressure additives evolve sulphur due to numerous volatile sulphur species being present, resulting in lubricating compositions containing antiwear or extreme pressure additives having an odour and possibly also being detrimental to health and the environment.

A lubricating composition having the correct balance of phosphorus antiwear or extreme pressure additives provides driveline power transmitting devices with prolonged life and efficiency with controlled deposit formation and oxidation stability. However, many of the antiwear or extreme pressure additives employed have limited oxidative stability, form deposits or increase corrosion. In addition, many phosphorus antiwear or extreme pressure additives typically also contain sulphur, which results in a lubricating composition containing the phosphorus antiwear or extreme pressure additives which may be odorous.

SUMMARY OF THE INVENTION

The objectives of the present invention include to provide at least one of antiwear performance, friction modification (particularly for enhancing fuel economy), reduced odour, improved oxidation stability, or lead or copper (typically lead) corrosion inhibition.

As used herein reference to the amounts of additives present in the lubricating composition disclosed herein are quoted on an oil free basis, i.e., amount of actives.

As used herein, the expression "(thio)phosphorylating agent, or reactive equivalents thereof" is meant to include a phosphorylating agent, a thiophosphorylating agent, or mixtures thereof. In one embodiment the phosphorylating agent does not contain sulphur. As used herein the expression "(thio)phosphorylating agent, or reactive equivalents thereof" may be used interchangeably with the expression "(thio)phosphating agent".

In one embodiment the present invention provides a lubricating composition comprising an oil of lubricating viscosity and a product obtained/obtainable by reacting: (i) a hydroxy-containing carboxylic compound, a (thio)phosphorylating agent, or reactive equivalents thereof (may include acid halides, esters, amides, anhydrides, salts, partial salts, or mixtures thereof), and optionally an alcohol (typically a monohydric alcohol), and optionally (ii) reacting the product of (i) with an amine, or mixtures thereof.

In one embodiment the hydroxy-containing carboxylic compound may be a hydroxy-carboxylic acid, or derivatives thereof, or a partially esterified polyol, or mixtures thereof. Derivatives of the hydroxy-carboxylic acid may include an ester, amide, or partial salts of amide or ester, (typically the derivative is a partial ester).

The hydroxy-containing carboxylic compound may be a hydroxy-containing carboxylic acid, or derivatives thereof (the derivative may include ester, amide, or partial salts of amide or ester, (typically partial ester), or derived from a partially esterified polyol (such as glycerol), or mixtures thereof. In one embodiment the hydroxy-containing carboxylic compound may be a hydroxy-containing carboxylic acid, or derivatives thereof, or mixtures thereof. In one embodiment the hydroxy-containing carboxylic compound may be derived from a partially esterified polyol (such as glycerol), or mixtures thereof.

The (thio)phosphorylating agent or reactive equivalents thereof may be mixed with and reacted with the hydroxy-containing carboxylic compound and the optional alcohol in any order.

The (thio)phosphorylating agent, or reactive equivalents thereof, itself may also be introduced into the reaction mixture in a single portion, or it may be introduced in multiple portions. Thus, in one embodiment, a reaction product (or intermediate) is prepared wherein a portion of the (thio)phosphorylating agent, or reactive equivalents thereof, is reacted the hydroxy-containing carboxylic compound and the optional alcohol, and thereafter a second charge of the phosphating agent is added.

In one embodiment the product may be obtained/obtainable by reacting the product of (i) with an amine, or mixtures thereof. The product may be an ammonium salt of a phosphate ester of the hydroxy-containing carboxylic compound (typically an ester derivative). For example the product may be an alkyl hydroxy-carboxylate phosphate dialkyl ammonium salt or mixtures thereof.

In one embodiment the present invention provides a lubricating composition comprising an oil of lubricating viscosity and a product obtained/obtainable by reacting: (i) a hydroxy-containing carboxylic compound, a (thio)phosphorylating agent, or reactive equivalents thereof, and in the absence of an alcohol, and optionally (ii) reacting the product of (i) with an amine, or mixtures thereof.

In one embodiment the present invention provides a lubricating composition comprising an oil of lubricating viscosity and a product obtained/obtainable by reacting: (i) a hydroxy-containing carboxylic compound, a (thio)phosphorylating agent, or reactive equivalents thereof, and an alcohol (typically a monohydric alcohol), and optionally (ii) reacting the product of (i) with an amine, or mixtures thereof. In one embodiment the invention provides a lubricating composition, wherein the product of (i) is further reacted with an amine, or mixtures thereof.

In one embodiment the present invention provides a lubricating composition comprising an oil of lubricating viscosity and a product obtained/obtainable by reacting: (i) a hydroxy-containing carboxylic compound, a sulphur-free phosphating agent, optionally an alcohol, and optionally (ii) reacting the product of (i) with an amine, or mixtures thereof.

In one embodiment the hydroxy-containing carboxylic compound may be a hydroxy-carboxylic acid, or derivatives thereof, a partially esterified polyol, or mixtures thereof.

The product obtained/obtainable by the process described herein may be present at 0.01 to 5 wt %, or 0.05 wt % to 2 wt %, or 0.1 wt % to 1 wt %, or 0.2 wt % to 0.5 wt % of the lubricating composition. In one embodiment the compound may be present at 0.2 wt % to 0.5 wt % of the lubricating composition.

In one embodiment the invention provides a method of lubricating an internal combustion engine comprising supplying to the internal combustion engine a lubricating composition as disclosed herein.

In one embodiment the invention provides a method of lubricating an internal combustion engine as disclosed herein, wherein the internal combustion engine has a surface of steel, or an aluminium alloy, or aluminium composite. The internal combustion engine may have a surface of steel.

In one embodiment the invention provides a method of lubricating an internal combustion engine as disclosed herein, wherein the internal combustion engine has a cylinder bore, cylinder block, piston, or piston ring having an aluminium alloy, aluminium composite or steel (i.e., iron-containing) surface.

In one embodiment the invention provides a method of lubricating a driveline device comprising supplying to the driveline device a lubricating composition as disclosed herein.

In one embodiment the invention provides for the use of a lubricating composition comprising an oil of lubricating viscosity and a product obtained/obtainable by reacting: (i) a hydroxy-containing carboxylic compound, a (thio)phosphorylating agent, or reactive equivalents thereof, and optionally an alcohol (typically a monohydric alcohol), and optionally (ii) reacting the product of (i) with an amine, or mixtures thereof, wherein the product obtained is an antiwear agent. Typically the product disclosed herein may be an antiwear agent in a lubricating composition for use in an internal combustion engine or a driveline device.

DETAILED DESCRIPTION OF THE INVENTION

The present invention provides a lubricating composition and a method for lubricating an internal combustion engine or a driveline device as disclosed above.

The (thio)phosphorylating agent, or reactive equivalents thereof which may be employed is typically phosphorus pentoxide, phosphorus pentasulphide, or reactive equivalents thereof. Phosphorus pentoxide is usually referred to as $P_2O_5$, which is its empirical formula and phosphorus pentasulphide is usually referred to as $P_2S_5$, which is its empirical formula, even though it is believed that both molecules consist at least in part of more complex molecules such as $P_4O_{10}$, or $P_4S_{10}$. Both such materials have phosphorus in its +5 oxidation state. The (thio)phosphorylating agent, or reactive equivalents thereof may include $POCl_3$, $P_2O_5$, $P_4O_{10}$, polyphosphoric acid, $P_2S_5$, or $P_4S_{10}$, or mixtures thereof. In one embodiment the (thio)phosphorylating agent, or reactive equivalents thereof may be a sulphur-free phosphating agent, typically $POCl_3$, $P_2O_5$, $P_4O_{10}$, or polyphosphoric acid.

The hydroxy-containing carboxylic compound may include a compound derived from a hydroxy-containing carboxylic compound represented by the formulae:

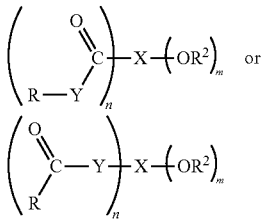

wherein n and m may be independently integers of 1 to 5;

X may be an aliphatic or alicyclic group, or an aliphatic or alicyclic group containing an oxygen atom in the carbon chain, or a substituted group of the foregoing types, said group containing up to 6 carbon atoms and having n+m available points of attachment;

each Y may be independently —O—, >NH, or >$NR^1$ or two Ys together representing the nitrogen of an imide structure R—N< formed between two carbonyl groups; and each R and $R^1$ may be independently hydrogen or a hydrocarbyl group, provided that at least one R or $R^1$ group is a hydrocarbyl group; each $R^2$ may be independently hydrogen, a hydrocarbyl group or an acyl group, further provided that at least one —$OR^2$ group is located on a carbon atom within X that is α or β to at least one of the —C(O)—Y—R groups, with the proviso that at least one $R^2$ group may be hydrogen.

The compound derived from the hydroxy-carboxylic acid may be derived from glycolic acid (n and m both equal 1), malic acid (n=2, m=1), tartaric acid (n and m both equal 2), citric acid (n=3, m=1), or mixtures thereof. In one embodiment the compound derived from the hydroxy-carboxylic acid may be derived from tartaric acid or glycolic acid, (typically tartaric acid).

The compound derived from the hydroxy-containing carboxylic compound may be derived from a partially esterified polyol (such as glycerol), or mixtures thereof. The partially esterified polyol may be glycerol monooleate, or glycerol dioleate. In one embodiment the esterified polyol may be a mixture of glycerol monooleate and glycerol dioleate.

The alcohol includes both monohydric alcohol and polyhydric alcohol. The carbon atoms of the alcohol may be linear, branched, or mixtures thereof. When branched, the alcohol may be a Guerbet alcohol, or mixtures thereof. A branched alcohol may contain 6 to 40 or 6 to 30, or 8 to 20 carbon atoms (typically 8 to 20 carbon atoms).

The Guerbet alcohols may have alkyl groups including the following:

1) alkyl groups containing $C_{15-16}$ polymethylene groups, such as 2-$C_{1-15}$ alkyl-hexadecyl groups (e.g. 2-octylhexadecyl) and 2-alkyl-octadecyl groups (e.g. 2-ethyloctadecyl, 2-tetradecyl-octadecyl and 2-hexadecyloctadecyl);

2) alkyl groups containing $C_{13-14}$ polymethylene groups, such as 1-$C_{1-15}$ alkyl-tetradecyl groups (e.g. 2-hexyltetradecyl, 2-decyltetradecyl and 2-undecyltridecyl) and 2-$C_{1-15}$ alkyl-hexadecyl groups (e.g. 2-ethyl-hexadecyl and 2-dodecylhexadecyl);

3) alkyl groups containing $C_{10-12}$polymethylene groups, such as 2-$C_{1-15}$ alkyl-dodecyl groups (e.g. 2-octyldodecyl) and 2-$C_{1-15}$ alkyl-dodecyl groups (2-hexyldodecyl and 2-octyldodecyl), 2-$C_{1-15}$ alkyl-tetradecyl groups (e.g. 2-hexyltetradecyl and 2-decyltetradecyl);

4) alkyl groups containing $C_{6-9}$ polymethylene groups, such as 2-$C_{1-15}$ alkyl-decyl groups (e.g. 2-octyldecyl) and 2,4-di-$C_{1-15}$ alkyl-decyl groups (e.g. 2-ethyl-4-butyl-decyl group);

5) alkyl groups containing $C_{1-5}$ polymethylene groups, such as 2-(3-methylhexyl)-7-methyl-decyl and 2-(1,4,4-trimethylbutyl)-5,7,7-trimethyl-octyl groups; and 6) and mixtures of two or more branched alkyl groups, such as alkyl residues of oxoalcohols corresponding to propylene oligomers (from hexamer to undecamer), ethylene/propylene (molar ratio 16:1-1:11) oligomers, iso-butene oligomers (from pentamer to octamer), $C_{5-17}$ α-olefin oligomers (from dimer to hexamer).

Examples of a suitable branched monohydric alcohol include 2-ethylhexanol, 2-butyloctanol, 2-hexyldecanol, 2-octyldodecanol, 2-decyltetradecanol, iso-tridecanol, iso-octanol, oleyl alcohol, Guerbet alcohols, or mixtures thereof.

Examples of a monohydric linear alcohol include methanol, ethanol, propanol, butanol, pentanol, hexanol, heptanol, octanol, nonanol, decanol, undecanol, dodecanol, tridecanol, tetradecanol, pentadecanol, hexadecanol, heptadecanol, octadecanol, nonadecanol, eicosanol, or mixtures thereof. In one embodiment the monohydric alcohol contains 6 to 30, or 8 to 20, or 8 to 15 carbon atoms (typically 8 to 15 carbon atoms).

The alcohol may include commercially available materials such as Oxo Alcohol® 7911, Oxo Alcohol® 7900 and Oxo Alcohol® 1100 of Monsanto; Alphanol® 79 of ICI; Nafol® 1620, Alfol® 610 and Alfol® 810 of Condea (now Sasol); Epal® 610 and Epal® 810 of Ethyl Corporation; Linevol® 79, Linevol® 911 and Dobanol® 25 L of Shell AG; Lial® 125 of Condea Augusta, Milan; Dehydad® and Lorol® of Henkel KGaA (now Cognis) as well as Linopol® 7-11 and Acropol® 91 of Ugine Kuhlmann.

The amine may be a linear or branched primary, secondary or tertiary amine, or mixtures thereof. The amine may be a monoamine or a polyamine, typically a linear or branched secondary or tertiary monoamine. In one embodiment the amine may be a branched secondary or tertiary monoamine, or mixtures thereof.

The amine may include dimethylamine, diethylamine, dipropylamine, dibutylamine, diamylamine, dihexylamine, diheptylamine, bis-2-ethylhexylamine, dioctylamine, dinonylamine, didecylamine, methylethylamine, ethylbutylamine, N-methyl-1-amino-cyclohexane, Armeen® 2C and ethylamylamine. The secondary amines may be cyclic amines such as piperidine, piperazine and morpholine.

Examples of tertiary amines include tri-n-butylamine, tri-n-octylamine, tri-decylamine, tri-laurylamine, tri-hexadecylamine, tri-(2-ethylhexyl)amine, and dimethyloleylamine (Armeen® DMOD).

In one embodiment the amines may be in the form of a mixture. Examples of suitable mixtures of amines include (i) a primary amine with about 11 to about 14 carbon atoms on tertiary alkyl groups, (ii) a primary amine with about 14 to about 18 carbon atoms on tertiary alkyl groups, or (iii) a primary amine with about 18 to about 22 carbon atoms on tertiary alkyl groups. Other examples of tertiary alkyl primary amines include tert-butylamine, tert-hexylamine, tert-octylamine (such as 1,1-dimethylhexylamine), tert-decylamine (such as 1,1-dimethyloctylamine), tert-dodecylamine, tert-tetradecylamine, tert-hexadecylamine, tert-octadecylamine, tert-tetracosanylamine, and tert-octacosanylamine.

In one embodiment a useful mixture of amines is "Primene® 81R" or "Primene® JMT." Primene® 81R and Primene® JMT (both produced and sold by Rohm & Haas, or Dow Chemicals) are mixtures of C11 to C14 tertiary alkyl primary amines and C18 to C22 tertiary alkyl primary amines, respectively.

In one embodiment the hydroxy-containing carboxylic compound, the (thio)phosphorylating agent, or reactive equivalents thereof, and the alcohol may be reacted at a temperature in the range of 30° C. to 100° C., or 40° C. to 70° C. The reaction may form a mono- or di-phosphate ester.

The reaction of the amine in step (ii) may be carried out at a temperature in the range of 30° C. to 120° C., or 40° C. to 90° C.

The relative molar amounts of the hydroxy-containing carboxylic compound to the alcohol may be 1:0 to 0.2:0.8, or 0.9:0.1 to 0.4:0.6. At a 1:1 mole ratio of the hydroxy-containing carboxylic compound having 2 or more hydroxyl groups to the alcohol (typically a monohydric alcohol), the mole ratio of hydroxyl groups to phosphorus atoms will be >1:1.

The hydroxy-containing carboxylic compound (and optionally the alcohol) are reacted with the (thio)phosphorylating agent, or reactive equivalents thereof in such overall amounts that the product mixture formed thereby contains (thio)phosphorus acid functionality. That is, the (thio)phosphorylating agent or reactive equivalents thereof is not completely converted to its ester form but will retain at least a portion of P—OH, or P—SH acidic functionality, which is accomplished by using a sufficient amount of the (thio)phosphorylating agent, or reactive equivalents thereof compared with the equivalent amounts of the hydroxy-containing carboxylic compound (and optionally the alcohol). Typically that means that the product mixture formed does not contain significant amounts of triesters of (thio)phosphorus acid. In particular, in certain embodiments the (thio)phosphorylating agent, or reactive equivalents thereof (which may comprise phosphorus pentoxide), may be reacted with the hydroxy-containing carboxylic compound (and optionally the alcohol) in a ratio of 1 to 2.5 moles (or equivalents) (or 1.25 to 2 moles, or 1.5 moles) of hydroxyl groups per 1 mole of phosphorus from the (thio)phosphorylating agent, or reactive equivalents thereof.

In one somewhat oversimplified schematic representation using $P_2O_5$ for illustrative purposes, the reaction of the phosphating agent with alcohol(s) may be represented as follows:

$$3ROH+P_2O_5 \rightarrow (RO)_2P(=O)OH+RO—P(=O)(OH)_2$$

where ROH represent hydroxyl groups of either (i) a hydroxy-containing carboxylic compound, or (ii) a mixture of the hydroxy-containing carboxylic compound with an alcohol (typically a monohydric alcohol). As will be seen below, the residual phosphoric acidic functionality may be reacted at least in part with an amine.

The product may be formed in the presence or absence of solvent.

Examples of an aromatic hydrocarbon solvent include aromatic hydrocarbon solvent include Shellsolv AB® (commercially available from Shell Chemical Company); and toluene extract, xylene Aromatic 200, Aromatic 150, Aromatic 100, Solvesso 200, Solvesso 150, Solvesso 100, HAN 857® (all commercially available from Exxon Chemical Company), or mixtures thereof. Other aromatic hydrocarbon solvents include xylene, toluene, or mixtures thereof.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056]. A more detailed description of natural and synthetic lubricating oils is described in paragraphs [0058] to [0059] respectively of WO2008/147704. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". In one embodiment the oil of lubricating viscosity may be an API Group II or Group III oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Other Performance Additives

A lubricating composition may be prepared by adding the product of the process described herein to an oil of lubricating viscosity, optionally in the presence of other performance additives (as described herein below).

The lubricating composition of the invention optionally comprises other performance additives. The other performance additives include at least one of metal deactivators, viscosity modifiers, detergents, friction modifiers, antiwear agents, corrosion inhibitors, dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

Antioxidants include sulphurised olefins, diarylamines or alkylated diarylamines, hindered phenols, molybdenum compounds (such as molybdenum dithiocarbamates), hydroxyl thioethers, or mixtures thereof. In one embodiment the lubricating composition includes an antioxidant, or mixtures thereof. The antioxidant may be present at 0 wt % to 15 wt %, or 0.1 wt % to 10 wt %, or 0.5 wt % to 5 wt %, or 0.5 wt % to 3 wt %, or 0.3 wt % to 1.5 wt % of the lubricating composition.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the diphenylamine may include nonyl diphenylamine, or dinonyl diphenylamine. The alkylated diarylamine may include octyl, di-octyl, nonyl, di-nonyl, decyl or di-decyl phenylnapthylamines.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of molybdenum dithiocarbamates which may be used as an antioxidant include commercial materials sold under the trade names such as Vanlube 822™ and Molyvan™ A from R. T. Vanderbilt Co., Ltd., and Adeka Sakura-Lube™ S-100, S-165, S-600 and 525, or mixtures thereof.

In one embodiment the lubricating composition further includes a viscosity modifier. The viscosity modifier is known in the art and may include hydrogenated styrene-butadiene rubbers, ethylene-propylene copolymers, polymethacrylates, polyacrylates, hydrogenated styrene-isoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof.

The dispersant viscosity modifier may include functionalised polyolefins, for example, ethylene-propylene copolymers that have been functionalized with an acylating agent such as maleic anhydride and an amine; polymethacrylates functionalised with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]).

In one embodiment the lubricating composition of the invention further comprises a dispersant viscosity modifier. The dispersant viscosity modifier may be present at 0 wt % to 15 wt %, or 0 wt % to 10 wt %, or 0.05 wt % to 5 wt %, or 0.2 wt % to 2 wt % of the lubricating composition.

The lubricating composition may further include a dispersant, or mixtures thereof. The dispersant may be a succinimide dispersant, a Mannich dispersant, a succinamide dispersant, a polyolefin succinic acid ester, amide, or ester-amide, or mixtures thereof. In one embodiment the dispersant may be present as a single dispersant. In one embodiment the dispersant may be present as a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetra-ethylenepentamine, pentaethylenehexamine, polyamine still bottoms, and mixtures thereof.

In one embodiment the dispersant may be a polyolefin succinic acid ester, amide, or ester-amide. For instance, a polyolefin succinic acid ester may be a polyisobutylene succinic acid ester of pentaerythritol, or mixtures thereof. A polyolefin succinic acid ester-amide may be a polyisobutylene succinic acid reacted with an alcohol (such as pentaerythritol) and an amine (such as a diamine, (typically diethyleneamine) or polyamine (typically tetraethylene pentamine).

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulphide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid.

The dispersant may be present at 0.01 wt % to 20 wt %, or 0.1 wt % to 15 wt %, or 0.1 wt % to 10 wt %, or 1 wt % to 6 wt %, or 1 to 3 wt % of the lubricating composition.

In one embodiment the invention provides a lubricating composition further comprising an overbased metal-containing detergent. The metal of the metal-containing detergent may be zinc, sodium, calcium, barium, or magnesium. Typically the metal of the metal-containing detergent may be sodium, calcium, or magnesium.

The overbased metal-containing detergent may be selected from the group consisting of non-sulphur containing phenates, sulphur containing phenates, sulphonates, salixarates, salicylates, and mixtures thereof, or borated equivalents thereof. The overbased detergent may be borated with a borating agent such as boric acid.

The overbased metal-containing detergent may also include "hybrid" detergents formed with mixed surfactant systems including phenate and/or sulphonate components, e.g. phenate/salicylates, sulphonate/phenates, sulphonate/salicylates, sulphonates/phenates/salicylates, as described; for example, in U.S. Pat. Nos. 6,429,178; 6,429,179; 6,153,565; and 6,281,179. Where, for example, a hybrid sulphonate/phenate detergent is employed, the hybrid detergent would be considered equivalent to amounts of distinct phenate and sulphonate detergents introducing like amounts of phenate and sulphonate soaps, respectively.

Typically an overbased metal-containing detergent may be a zinc, sodium, calcium or magnesium salt of a phenate, sulphur containing phenate, sulphonate, salixarate or salicylate. Overbased salixarates, phenates and salicylates typically have a total base number of 180 to 450 TBN. Overbased sulphonates typically have a total base number of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). The predominantly linear alkylbenzene sulphonate detergent may be particularly useful for assisting in improving fuel economy.

Typically the overbased metal-containing detergent may be a calcium or magnesium an overbased detergent.

Overbased detergents are known in the art. Overbased materials, otherwise referred to as overbased or superbased salts, are generally single phase, homogeneous Newtonian systems characterized by a metal content in excess of that which would be present for neutralization according to the stoichiometry of the metal and the particular acidic organic compound reacted with the metal (typically a metal base). The overbased materials are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a calcium chloride, acetic acid, phenol or alcohol. The acidic organic material will normally have a sufficient number of carbon atoms to provide a degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 3.5 times as much metal as present in a normal salt will have metal excess of 3.5 equivalents, or a ratio of 4.5. The term "metal ratio is also explained in standard textbook entitled "Chemistry and Technology of Lubricants", Second Edition, Edited by R. M. Mortier and S. T. Orszulik, Copyright 1997.

In one embodiment the friction modifier may be selected from the group consisting of long chain fatty acid derivatives of amines, long chain fatty esters, or derivatives of a long chain fatty epoxides; fatty imidazolines; amine salts of alkylphosphoric acids; fatty alkyl tartrates; fatty alkyl tartrimides; fatty alkyl tartramides; fatty glycolates; and fatty glycolamides. The friction modifier may be present at 0 wt % to 6 wt %, or 0.01 wt % to 4 wt %, or 0.05 wt % to 2 wt %, or 0.1 wt % to 2 wt % of the lubricating composition.

As used herein the term "fatty alkyl" or "fatty" in relation to friction modifiers means a carbon chain having 10 to 22 carbon atoms, typically a straight carbon chain.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulphurised fatty compounds and olefins, molybdenum dialkyldithiophosphates, molybdenum dithiocarbamates, sunflower oil or soybean oil monoester of a polyol and an aliphatic carboxylic acid.

In one embodiment the friction modifier may be a long chain fatty acid ester. In another embodiment the long chain fatty acid ester may be a mono-ester and in another embodiment the long chain fatty acid ester may be a (tri)glyceride.

The lubricating composition optionally further includes at least one antiwear agent. Examples of suitable antiwear agents include titanium compounds, tartrates, tartrimides, oil soluble amine salts of phosphorus compounds, sulphurised olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulphides. The antiwear agent may in one embodiment include a tartrate, or tartrimide as disclosed in International Publication WO 2006/044411 or Canadian Patent CA 1 183 125. The tartrate or tartrimide may contain alkyl-ester groups, where the sum of carbon atoms on the alkyl groups is at least 8. The antiwear agent may in one embodiment include a citrate as is disclosed in US Patent Application 20050198894.

Another class of anti-wear additives includes oil-soluble titanium compounds as disclosed in U.S. Pat. No. 7,727,943 and US20060014651. The oil-soluble titanium compounds may function as antiwear agents, friction modifiers, antioxidants, deposit control additives, or more than one of these functions. In one embodiment the oil soluble titanium compound is a titanium (IV) alkoxide. The titanium alkoxide is formed from a monohydric alcohol, a polyol or mixtures thereof. The monohydric alkoxides may have 2 to 16, or 3 to 10 carbon atoms. In one embodiment, the titanium alkoxide is titanium (IV) isopropoxide. In one embodiment, the titanium alkoxide is titanium (IV) 2-ethylhexoxide. In one embodiment, the titanium compound comprises the alkoxide of a vicinal 1,2-diol or polyol. In one embodiment, the 1,2-vicinal diol comprises a fatty acid mono-ester of glycerol, often the fatty acid is oleic acid.

In one embodiment, the oil soluble titanium compound is a titanium carboxylate. In one embodiment the titanium (IV) carboxylate is titanium neodecanoate.

In one embodiment the oil soluble titanium compound may be present in the lubricating composition in an amount necessary to provide for 0 ppm to 1500 ppm titanium by weight, or 10 ppm to 1500 ppm titanium by weight, or 25 ppm to 150 ppm titanium by weight.

Extreme Pressure (EP) agents that are soluble in the oil include sulphur- and chlorosulphur-containing EP agents, dimercaptothiadiazole or $CS_2$ derivatives of dispersants (typically succinimide dispersants), derivative of chlorinated hydrocarbon EP agents and phosphorus EP agents. Examples of such EP agents include chlorinated wax; sulphurised olefins (such as sulphurised isobutylene), a hydrocarbyl-substituted 2,5-dimercapto-1,3,4-thiadiazole, or oligomers thereof, organic sulphides and polysulphides such as dibenzyl-disulphide, bis-(chlorobenzyl) disulphide, dibutyl trisulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described in U.S. Pat. No. 3,197,405).

Foam inhibitors that may be useful in the compositions of the invention include polysiloxanes, copolymers of ethyl acrylate, and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene copolymers, poly(meth)acrylates, polyacrylates or polyacrylamides.

Demulsifiers include trialkyl phosphates, and various polymers and copolymers of ethylene glycol, ethylene oxide, propylene oxide, or mixtures thereof.

Metal deactivators include derivatives of benzotriazoles (typically tolyltriazole), 1,2,4-triazoles, benzimidazoles, 2-alkyldithiobenzimidazoles or 2-alkyldithiobenzothiazoles, or dimercaptothiadiazole (DMTD). The metal deactivators may also be described as corrosion inhibitors.

Seal swell agents include sulfolene derivatives Exxon Necton37™ (FN 1380) and Exxon Mineral Seal Oil™ (FN 3200).

INDUSTRIAL APPLICATION

The lubricating composition of the present invention may be useful in an internal combustion engine, a driveline device, a hydraulic system, a grease, a turbine, or a refrigerant. If the lubricating composition is part of a grease composition, the composition further comprises a thickener. The thickener may include simple metal soap thickeners, soap complexes, non-soap thickeners, metal salts of such acid-functionalized oils, polyurea and diurea thickeners, calcium sulphonate thickeners or mixtures thereof. Thickeners for grease are well known in the art.

In one embodiment the invention provides a method of lubricating an internal combustion engine. The engine components may have a surface of steel or aluminium.

An aluminium surface may be derived from an aluminium alloy that may be a eutectic or a hyper-eutectic aluminium alloy (such as those derived from aluminium silicates, aluminium oxides, or other ceramic materials). The aluminium surface may be present on a cylinder bore, cylinder block, piston or piston ring having an aluminium alloy, or aluminium composite.

The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine, a mixed gasoline/alcohol fuelled engine, or a hydrogen fuelled internal combustion engine. In one embodiment the internal combustion engine may be a diesel fuelled engine and in another embodiment a gasoline fuelled engine. In one embodiment the internal combustion engine may be a heavy duty diesel engine.

The internal combustion engine may be a 2-stroke or 4-stroke engine. Suitable internal combustion engines include marine diesel engines, aviation piston engines, low-load diesel engines, and automobile and truck engines. The marine diesel engine may be lubricated with a marine diesel cylinder lubricant (typically in a 2-stroke engine), a system oil (typically in a 2-stroke engine), or a crankcase lubricant (typically in a 4-stroke engine).

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 0.04 wt % to 0.12 wt %. In one embodiment the phosphorus content may be 100 ppm to 1000 ppm, or 200 ppm to 600 ppm. The total sulphated ash content may be 0.3 wt % to 1.2 wt %, or 0.5 wt % to 1.1 wt % of the lubricating composition. In one embodiment the sulphated ash content may be 0.5 wt % to 1.1 wt % of the lubricating composition.

In one embodiment the lubricating composition may be an engine oil, wherein the lubricating composition may be characterised as having at least one of (i) a sulphur content of 0.5 wt % or less, (ii) a phosphorus content of 0.12 wt % or less, and (iii) a sulphated ash content of 0.5 wt % to 1.1 wt % of the lubricating composition.

An engine lubricating composition may further include other additives. In one embodiment the invention provides a lubricating composition further comprising at least one of a dispersant, an antiwear agent, a dispersant viscosity modifier (other than the compound of the invention), a friction modifier, a viscosity modifier, an antioxidant, an overbased detergent, or mixtures thereof. In one embodiment the invention provides a lubricating composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulphonates and phenates), or mixtures thereof.

In one embodiment an engine lubricating composition may be a lubricating composition further comprising a molybdenum compound. The molybdenum compound may be an antiwear agent or an antioxidant. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

An engine lubricating composition may further include a phosphorus-containing antiwear agent. Typically the phosphorus-containing antiwear agent may be a zinc dialkyldithiophosphate, a phosphite, a phosphate, a phosphonate, and an ammonium phosphate salt, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition.

The overbased detergent may be present at 0 wt % to 15 wt %, or 0.1 wt % to 10 wt %, or 0.2 wt % to 8 wt %, or 0.2 wt % to 3 wt %. For example in a heavy duty diesel engine the detergent may be present at 2 wt % to 3 wt % of the lubricating composition. For a passenger car engine the detergent may be present at 0.2 wt % to 1 wt % of the lubricating composition. In one embodiment, an engine lubricating composition further comprises at least one overbased detergent with a metal ratio of at least 3, or at least 8, or at least 15.

Useful corrosion inhibitors for an engine lubricating composition include those described in paragraphs 5 to 8 of WO2006/047486, octylamine octanoate, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

In one embodiment the lubricating composition of the invention further comprises a dispersant viscosity modifier. The dispersant viscosity modifier may be present at 0 wt % to 5 wt %, or 0 wt % to 4 wt %, or 0.05 wt % to 2 wt %, or 0.2 wt % to 1.2 wt % of the lubricating composition.

An engine lubricating composition in different embodiments may have a composition as disclosed in the following table:

| | Embodiments (wt %) | | |
|---|---|---|---|
| Additive | A | B | C |
| Product of Invention | 0.01 to 5 | 0.05 to 2 | 0.1 to 1 |
| Dispersant | 0 to 12 | 0 to 8 | 0.5 to 6 |
| Dispersant Viscosity Modifier | 0 to 5 | 0 to 4 | 0.05 to 2 |
| Overbased Detergent | 0.1 to 15 | 0.1 to 10 | 0.2 to 8 |
| Antioxidant | 0.1 to 13 | 0.1 to 10 | 0.5 to 5 |
| Antiwear Agent | 0.1 to 15 | 0.1 to 10 | 0.3 to 5 |
| Friction Modifier | 0.01 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

Driveline Device

In one embodiment the method and lubricating composition of the invention may be suitable for a driveline device. The driveline device includes at least one of gear oils, axle oils, drive shaft oils, traction oils, manual transmission oils, automatic transmission oils, or off highway oils (such as a farm tractor oil). In one embodiment the invention provides a method of lubricating a manual transmission that may or may not contain a synchronizer system. In one embodiment the invention provides a method of lubricating an automatic transmission. In one embodiment the invention provides a method of lubricating an axle.

A lubricating composition for a driveline device may have a sulphur-content of greater than 0.05 wt %, or 0.4 wt % to 5 wt %, or 0.5 wt % to 3 wt %, 0.8 wt % to 2.5 wt %, 1 wt % to 2 wt %, 0.075 wt % to 0.5 wt %, or 0.1 wt % to 0.25 wt % of the lubricating composition.

A lubricating composition for a driveline device may have a phosphorus content of 100 ppm to 5000 ppm, or 200 ppm to 4750 ppm, 300 ppm to 4500 ppm, or 450 ppm to 4000 ppm.

An automatic transmission includes continuously variable transmissions (CVT), infinitely variable transmissions (IVT), toroidal transmissions, continuously slipping torque converter clutches (CSTCC), stepped automatic transmissions or dual clutch transmissions (DCT).

Automatic transmissions can contain continuously slipping torque converter clutches (CSTCC), wet start and shifting clutches and in some cases may also include metal or composite synchronizers.

Dual clutch transmissions or automatic transmissions may also incorporate electric motor units to provide a hybrid drive.

A manual transmission lubricant may be used in a manual gearbox which may be unsynchronized, or may contain a synchronizer mechanism. The gearbox may be self-contained, or may additionally contain any of a transfer gearbox, planetary gear system, differential, limited slip differential or torque vectoring device, which may be lubricated by a manual transmission fluid.

The gear oil or axle oil may be used in planetary hub reduction axles, mechanical steering and transfer gear boxes in utility vehicles, synchromesh gear boxes, power take-off gears, limited slip axles, and planetary hub reduction gear boxes.

If the lubricating composition of the invention is suitable for a driveline device, a succinimide dispersant as generally described previously may be used. In one embodiment the succinimide dispersant may be an N-substituted long chain alkenyl succinimide. The long chain alkenyl succinimide may include polyisobutylene succinimide, wherein the polyisobutylene from which it is derived has a number average molecular weight in the range 350 to 5000, or 500 to 3000, or 750 to 1150.

In one embodiment the dispersant for a driveline device may be a post treated dispersant. The dispersant may be post treated with dimercaptothiadiazole, optionally in the presence of one or more of a phosphorus compound, a dicarboxylic acid of an aromatic compound, and a borating agent.

In one embodiment the post treated dispersant may be formed by heating an alkenyl succinimide or succinimide detergent with a phosphorus ester and water to partially hydrolyze the ester. The post treated dispersant of this type is disclosed for example in U.S. Pat. No. 5,164,103.

In one embodiment the post treated dispersant may be produced by preparing a mixture of a dispersant and a dimercaptothiadiazole and heating the mixture above about 100° C. The post treated dispersant of this type is disclosed for example in U.S. Pat. No. 4,136,043.

In one embodiment the dispersant may be post treated to form a product prepared comprising heating together: (i) a dispersant (typically a succinimide), (ii) 2,5-dimercapto-1,3,4-thiadiazole or a hydrocarbyl-substituted 2,5-dimercapto-1,3,4-thiadiazole, or oligomers thereof, (iii) a borating agent (similar to those described above); and (iv) optionally a dicarboxylic acid of an aromatic compound selected from the group consisting of 1,3 diacids and 1,4 diacids (typically terephthalic acid), or (v) optionally a phosphorus acid compound (including either phosphoric acid or phosphorous acid), said heating being sufficient to provide a product of (i), (ii), (iii) and optionally (iv) or optionally (v), which is soluble in an oil of lubricating viscosity. The post treated dispersant of this type is disclosed for example in International Application WO 2006/654726 A.

Examples of a suitable dimercaptothiadiazole include 2,5-dimercapto-1,3,4-thiadiazole or a hydrocarbyl-substituted 2,5-dimercapto-1,3,4-thiadiazole. In several embodiments the number of carbon atoms on the hydrocarbyl-substituent group includes 1 to 30, 2 to 25, 4 to 20, or 6 to 16. Examples of suitable 2,5-bis(alkyl-dithio)-1,3,4-thiadiazoles include 2,5-bis(tert-octyldithio)-1,3,4-thiadiazole 2,5-bis(tert-nonyldithio)-1,3,4-thiadiazole, 2,5-bis(tert-decyldithio)-1,3,4-thiadiazole, 2,5-bis(tert-undecyldithio)-1,3,4-thiadiazole, 2,5-bis(tert-dodecyldithio)-1,3,4-thiadiazole, 2,5-bis(tert-tridecyldithio)-1,3,4-thiadiazole, 2,5-bis(tert-tetradecyldithio)-1,3,4-thiadiazole, 2,5-bis(tert-pentadecyl-dithio)-1,3,4-thiadiazole, 2,5-bis(tert-hexadecyldithio)-1,3,4-thiadiazole, 2,5-bis(tert-heptadecyldithio)-1,3,4-thiadiazole, 2,5-bis(tert-octadecyldithio)-1,3,4-thiadiazole, 2,5-bis(tert-nonadecyldithio)-1,3,4-thiadiazole or 2,5-bis(tert-eicosyldithio)-1,3,4-thiadiazole, or oligomers thereof.

In one embodiment the oil soluble phosphorus amine salt antiwear agent includes an amine salt of a phosphorus acid ester or mixtures thereof. The amine salt of a phosphorus acid ester includes phosphoric acid esters and amine salts thereof; dialkyldithiophosphoric acid esters and amine salts thereof; phosphites; and amine salts of phosphorus-containing carboxylic esters, ethers, and amides; hydroxy substituted di or tri esters of phosphoric or thiophosphoric acid and amine salts thereof; phosphorylated hydroxy substituted di or tri esters of phosphoric or thiophosphoric acid and amine salts thereof; and mixtures thereof. The amine salt of a phosphorus acid ester may be used alone or in combination.

In one embodiment the oil soluble phosphorus amine salt includes partial amine salt-partial metal salt compounds or mixtures thereof. In one embodiment the phosphorus compound further includes a sulphur atom in the molecule.

Examples of the antiwear agent may include a non-ionic phosphorus compound (typically compounds having phosphorus atoms with an oxidation state of +3 or +5). In one embodiment the amine salt of the phosphorus compound may be ashless, i.e., metal-free (prior to being mixed with other components).

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or in other embodiments 8 to 26, or 10 to 20, or 13 to 19 carbon atoms.

Primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include bis-2-ethylhexyl amine, dimethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine and morpholine.

The amine may also be a tertiary-aliphatic primary amine. The aliphatic group in this case may be an alkyl group containing 2 to 30, or 6 to 26, or 8 to 24 carbon atoms. Tertiary alkyl amines include monoamines such as tert-butylamine, tert-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanylamine, and tert-octacosanylamine.

In one embodiment the phosphorus acid amine salt includes an amine with C11 to C14 tertiary alkyl primary groups or mixtures thereof. In one embodiment the phosphorus acid amine salt includes an amine with C14 to C18 tertiary alkyl primary amines or mixtures thereof. In one embodiment the phosphorus acid amine salt includes an amine with C18 to C22 tertiary alkyl primary amines or mixtures thereof.

Mixtures of amines may also be used in this optional antiwear agent. In one embodiment a useful mixture of amines is "Primene® 81R" and "Primene® JMT." Primene® 81R and Primene® JMT (both produced and sold by Rohm & Haas, or Dow Chemicals) are mixtures of C11 to C14 tertiary alkyl primary amines and C18 to C22 tertiary alkyl primary amines respectively.

In one embodiment oil soluble amine salts of phosphorus compounds include a sulphur-free amine salt of a phosphorus-containing compound may be obtained/obtainable by a process comprising: reacting an amine with either (i) a hydroxy-substituted di-ester of phosphoric acid, or (ii) a phosphorylated hydroxy-substituted di- or tri-ester of phosphoric acid. A more detailed description of compounds of this type is disclosed in International Application PCT/US08/051126 (or equivalent to U.S. application Ser. No. 11/627,405).

In one embodiment the hydrocarbyl amine salt of an alkylphosphoric acid ester is the reaction product of a C14 to C18 alkylated phosphoric acid with Primene 81R™ (produced and sold by Rohm & Haas, or Dow Chemicals) which is a mixture of C11 to C14 tertiary alkyl primary amines.

Examples of hydrocarbyl amine salts of dialkyldithiophosphoric acid esters include the reaction product(s) of isopropyl, methyl-amyl (4-methyl-2-pentyl or mixtures thereof), 2-ethylhexyl, heptyl, octyl or nonyl dithiophosphoric acids with ethylene diamine, morpholine, or Primene 81R™, and mixtures thereof.

In one embodiment the dithiophosphoric acid may be reacted with an epoxide or a glycol. This reaction product is further reacted with a phosphorus acid, anhydride, or lower ester. The epoxide includes an aliphatic epoxide or a styrene oxide. Examples of useful epoxides include ethylene oxide, propylene oxide, butene oxide, octene oxide, dodecene oxide, and styrene oxide. In one embodiment the epoxide may be propylene oxide. The glycols may be aliphatic glycols having from 1 to 12, or from 2 to 6, or 2 to 3 carbon atoms. The dithiophosphoric acids, glycols, epoxides, inorganic phosphorus reagents and methods of reacting the same are described in U.S. Pat. Nos. 3,197,405 and 3,544,465. The resulting acids may then be salted with amines. An example of suitable dithiophosphoric acid derivative is prepared by adding phosphorus pentoxide (about 64 grams) at 58° C. over a period of 45 minutes to 514 grams of hydroxypropyl O,O-di(4-methyl-2-pentyl)phosphorodithioate (prepared by reacting di(4-methyl-2-pentyl)-phosphorodithioic acid with 1.3 moles of propylene oxide at 25° C.). The mixture may be heated at 75° C. for 2.5 hours, mixed with a diatomaceous earth and filtered at 70° C. The filtrate contains 11.8% by weight phosphorus, 15.2% by weight sulphur, and an acid number of 87 (bromophenol blue).

The dithiocarbamate-containing compounds may be prepared by reacting a dithiocarbamate acid or salt with an unsaturated compound. The dithiocarbamate containing compounds may also be prepared by simultaneously reacting an amine, carbon disulphide and an unsaturated compound. Generally, the reaction occurs at a temperature from 25° C. to 125° C.

Examples of suitable olefins that may be sulphurised to form a sulphurised olefin include propylene, butylene, isobutylene, pentene, hexane, heptene, octane, nonene, decene, undecene, dodecene, undecyl, tridecene, tetradecene, pentadecene, hexadecene, heptadecene, octadecene, octadecenene, nonodecene, eicosene or mixtures thereof. In one embodiment, hexadecene, heptadecene, octadecene, octadecenene, nonodecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butyl acrylate.

Another class of sulphurised olefin includes fatty acids and their esters. The fatty acids are often obtained from vegetable oil or animal oil; and typically contain 4 to 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. In one embodiment fatty acids and/or ester are mixed with olefins.

Corrosion inhibitors useful for a driveline device include 1-amino-2-propanol, amines, triazole derivatives including tolyl triazole, dimercaptothiadiazole derivatives, octylamine octanoate, condensation products of dodecenyl succinic acid or anhydride and/or a fatty acid such as oleic acid with a polyamine.

A driveline device lubricating composition may contain an overbased detergent that may or may not be borated. For example the lubricating composition may contain a borated overbased calcium or magnesium sulphonate detergent, or mixtures thereof.

A driveline device lubricating composition in different embodiments may have a composition as disclosed in the following table:

| | Embodiments (wt %) | | | |
|---|---|---|---|---|
| Additive | A | B | C | D |
| Product of Invention | 0.01 to 5 | 0.05 to 2 | 0.1 to 1 | 0.2 to 0.5 |
| Dispersant | 1 to 4 | 2 to 7 | 0 to 5 | 1 to 6 |
| Extreme Pressure Agent | 3 to 6 | 0 to 6 | 0 to 3 | 0 to 6 |
| Overbased Detergent | 0 to 1 | 0.01 to 2 | 0.5 to 6 | 0.01 to 2 |
| Antioxidant | 0 to 5 | 0.01 to 2 | 0 to 3 | 0 to 2 |
| Antiwear Agent | 0.5 to 5 | 0.01 to 3 | 0.5 to 3 | 0.01 to 3 |
| Friction Modifier | 0 to 5 | 0.01 to 5 | 0.1 to 1.5 | 0 to 5 |
| Viscosity Modifier | 0.1 to 70 | 0.1 to 15 | 1 to 60 | 0.1 to 70 |
| Any Other Performance Additive | 0 to 10 | 0 to 8 | 0 to 6 | 0 to 10 |
| Oil of Lubricating Viscosity | Balance to 100% | Balance to 100% | Balance to 100% | Balance to 100% |

Footnote:

The viscosity modifier in the table above may also be considered as an alternative to an oil of lubricating viscosity.

Column A may be representative of an automotive or axle gear lubricant.

Column B may be representative of an automatic transmission lubricant.

Column C may be representative of an off-highway lubricant.

Column D may be representative of a manual transmission lubricant.

The following examples provide illustrations of the invention. These examples are non-exhaustive and are not intended to limit the scope of the invention.

EXAMPLES

Preparative Example 1 (Prep1)

A 500 ml flask is charged with glycerol monooleate (356.54 g), and iso-octanol (1130 g). The flask is fitted with a flange lid and clip, PTFE stirrer gland, rod and overhead stirrer, thermocouple, water-cooled condenser, nitrogen inlet port and powder dropping funnel. The flask is heated to 50° C. with stirring at 350 rpm. Phosphorus pentoxide (141.9 g) is charged to the dropping funnel under $N_2$ and then charged to the flask over one hour. The temperature is kept below 60° C. The flask is stirred at 50° C. for 18 hours. Vacuum (2-4 kPa, 20-40 mbar) is applied to the reaction mixture for 2 hours to remove volatile components and the phosphate intermediate is the cooled to room temperature.

Preparative Example 2 (Prep2)

A 250 ml flask is charged with the product of Preparative Example 1 (30 g) and bis-2-ethylhexylamine (19.6 g). The flask is fitted with a flange lid, PTFE stirrer gland, stirrer rod and overhead stirrer, water-cooled condenser, nitrogen port and thermocouple. The flask is heated to 70° C. with stirring at 200 rpm and held for 2 hours. The flask is then cooled to ambient temperature. A yellow/orange viscous liquid is obtained.

Preparative Example 3 (Prep3)

A 500 ml flask is charged with 293.3 g of an alkyl tartrate (where alkyl tartrate is obtained by esterification of tartaric acid with a mixture of (i) linear $C_{12-14}$ alcohols and (ii) isotridecacanol in ratio of 90 parts to 10 parts). The flask is fitted with a flange lid and clip, PTFE stirrer gland, rod and overhead stirrer, thermocouple, water-cooled condenser, nitrogen inlet port and powder dropping funnel. The flask is heated to 50° C. with stirring at 350 rpm. $P_2O_5$ (50 g) is charged to the dropping funnel under $N_2$ and then charged to the flask over one hour keeping the temperature below 60° C. The flask is stirred at 50° C. for 18 hours. The product is then vacuum distilled, before cooling to ambient temperature. A dark brown liquid is obtained.

Preparative Example 4 (Prep4)

30 g of the product of Preparative Example 3 is charged into a 250 ml flask with 11.9 g of bis-2-ethyhexylamine. The flask was fitted with a flange lid, PTFE stirrer gland, stirrer rod and overhead stirrer, water-cooled condenser, nitrogen port and thermocouple. The flask is heated to 70° C. with stirring at 200 rpm and held for 2 hours. A yellow/orange viscous liquid is obtained.

Preparative Example 5 (Prep5)

A 500 mL 3-necked round bottom flask equipped with magnetic stirrer, thermocouple and solid addition hopper with a 2-neck adaptor with nitrogen purge line and a bubbler to keep the system under a constant nitrogen blanket. Oleyl glycolate (200.21 g) is charged to the flask and heated to 60° C. with stirring. Phosphorus pentoxide (58.76 g) is added to the solid addition hopper and packed down under the nitrogen blanket. The phosphorus pentoxide is then added slowly over 3 hours, controlling the exotherm to keep the temperature of the reaction between 55° C. and 65° C. The reaction is then left to cool overnight with a nitrogen purge. The next day the mixture is heated to 70° C. with stirring for 5 hours and cooled to room temperature. A dark brown liquid is obtained.

Preparative Example 6 (Prep6)

A 500 mL 3-necked round bottom flask equipped with magnetic stirrer, thermocouple and pressure equalising dropping funnel with nitrogen purge line is set up. 228.5 g of Preparative Example 5 is charged to the flask and heated to 70° C. on a hotplate with stirring. 155.65 g of bis-2-ethyhexylamine is charged followed by manual mixing with a spatula until a homogeneous material is obtained. An exotherm of 20° C., bringing the reaction temperature to 90° C., is observed. The contents of the flask are stirred for 10 minutes before being cooled and left with a nitrogen purge overnight. The reaction mixture is heated to 70° C. with stirring for 6 hours. Product is then vacuum filtered through filter aid for 5 hours.

Preparative Example 7 (Prep7)

A 2 L flask is charged with n-butanol (222 g), and diethyl malate (295 g). The flask is fitted with a flange lid and clip, PTFE stirrer gland, rod and overhead stirrer, thermocouple, water-cooled condenser, nitrogen inlet port and powder dropping funnel. The flask is heated to 50° C. with stirring at 350 rpm. Phosphorus pentoxide (220 g) is charged to the dropping funnel under $N_2$ and then charged to the flask over one hour and 20 minutes. The temperature is kept below 60° C. The flask is stirred at 50° C. for 24 hours. Vacuum (2-4 kPa, 20-40 mbar) is applied to the reaction mixture for 1 hours to remove volatile components and the phosphate intermediate is then cooled to room temperature.

Preparative Example 8 (Prep8)

A 2 L flask is charged with the product of Preparative Example 7 (402 g). The flask is fitted with a flange lid, PTFE stirrer gland, stirrer rod and overhead stirrer, water-cooled condenser, nitrogen port, thermocouple and dropping funnel. The flask is heated to 48° C. The dropping funnel is charged with bis-2-ethylhexylamine (532 g) which is then added over 2 hours. The flask is heated to 70° C. with stirring at 200 rpm and held for 1.5 hours. The flask is then cooled to ambient temperature. A yellow viscous liquid is obtained.

Preparative Example 9 (Prep9)

A 2 L flask is charged with butanol (288.5 g), and butyl glycolate (294 g). The flask is fitted with a flange lid and clip, PTFE stirrer gland, rod and overhead stirrer, thermocouple, water-cooled condenser, nitrogen inlet port and powder dropping funnel. The flask is heated to 50° C. with stirring at 350 rpm. Phosphorus pentoxide (293 g) is charged to the dropping funnel under $N_2$ and then charged to the flask over one hour and 50 minutes. The temperature is kept below 60° C. The flask is stirred at 50° C. for 24 hours. The phosphate intermediate is then cooled to room temperature.

Preparative Example 10 (Prep10)

A 3 L flask is charged with the product of Preparative Example 9 (679 g). The flask is fitted with a flange lid, PTFE stirrer gland, stirrer rod and overhead stirrer, water-cooled condenser, nitrogen port, thermocouple and dropping funnel. The flask is heated to 48° C. The dropping funnel is charged with bis-2-ethylhexylamine (595 g) which is then added over 2 hours. The flask is heated to 70° C. with stirring at 200 rpm and held for 2 hours. The flask is then cooled to ambient temperature. A yellow viscous liquid is obtained.

Preparative Example 11 (Prep11)

A 2 L flask is charged with 4-methyl pentan-2-ol (408 g), and butyl glycolate (264 g). The flask is fitted with a flange lid and clip, PTFE stirrer gland, rod and overhead stirrer, thermocouple, water-cooled condenser, nitrogen inlet port and powder dropping funnel. The flask is heated to 50° C. with stirring at 350 rpm. Phosphorus pentoxide (293 g) is charged to the dropping funnel under $N_2$ and then charged to the flask over one hour and 15 minutes. The temperature is kept below 60° C. The flask is stirred at 50° C. for 19 hours. Vacuum (2-4 kPa, 20-40 mbar) is applied to the reaction mixture for 2 hours to remove volatile components and the phosphate intermediate is the cooled to room temperature.

Preparative Example 12 (Prep12)

A 3 L flask is charged with the product of Preparative Example 11 (800 g). The flask is fitted with a flange lid, PTFE stirrer gland, stirrer rod and overhead stirrer, water-cooled condenser, nitrogen port, thermocouple and dropping funnel. The flask is heated to 48° C. The dropping funnel is charged with bis-2-ethylhexylamine (821 g) which is then added over 3.5 hours. The flask is heated to 70° C. with stirring at 200 rpm and held for 2 hours. The flask is then cooled to ambient temperature. A yellow viscous liquid is obtained.

A series of SAE 5W-30 engine lubricants are prepared containing antioxidants (mixture of hindered phenols and alkylated diphenylamines), an overbased calcium sulphonate detergent, a succinimide dispersant, and further containing a source of phosphorus. The phosphorus is delivered by either zinc dialkyldithiophosphate (ZDDP) or the product of the present invention. The phosphorus-containing additives for the lubricants prepared are summarised as follows:

| SAE 5W-30 Lubricant | Phosphorus Source | Phosphorus delivered (ppm) |
|---|---|---|
| CE1 | ZDDP | 600 |
| LUB1 | Prep4 | 600 |
| LUB2 | Prep6 | 600 |
| LUB3 | Prep2 | 600 |
| LUB4* | Prep2 | 600 |
| CE2 | ZDDP | 1000 |
| LUB5 | Prep4 | 1000 |
| LUB6 | Prep2 | 1000 |
| LUB7 | Prep6 | 1000 |

Footnote:
*indicates the lubricant further contained 0.5 wt % of oleyl tartrate.

The SAE 5W-30 lubricants are evaluated for boundary lubrication friction performance and wear in a programmed temperature high frequency reciprocating rig (HFRR) available from PCS Instruments. HFRR conditions for the evaluations were 200 g load, 75 minute duration, 1000 micrometer stroke, 20 Hertz frequency, and temperature programme of 15 minutes at 40° C., then the temperature is raised to 160° C. at a rate of 2° C./min. The contact potential is measured by applying a small electrical potential between the upper and lower test specimens. The test specimens are either steel engine parts, or aluminium silicate engine part commercially sold under trademark Alusil®. If the instrument measures the full electrical potential applied, this is indicative of an electrically insulating layer between the upper and lower test specimens, this is usually interpreted as the formation of a chemical protective film on the surfaces. If no protective film is formed there is metal to metal contact between the upper and lower test specimens and the measured electrical potential drops to zero. Intermediate values are indicative of partial or incomplete protective films. The contact potential is often presented as a percentage of the applied electrical potential and called percent film thickness. The wear, and contact potential (C.o.F) results obtained are presented in the following table:

| SAE 5W-30 Lubricant | Steel Engine Part Wear Scar (μm) | Steel Engine Part C.o.F | Al Engine Part Wear Scar (μm) |
|---|---|---|---|
| CE1 | 215 | 0.122 | 250 |
| LUB1 | 190 | 0.117 | 219 |
| LUB2 | 198 | 0.114 | 208 |
| LUB3 | 202 | 0.115 | 223 |
| CE2 | 224 | 0.131 | 271 |
| LUB5 | 198 | 0.117 | 224 |
| LUB6 | 213 | 0.118 | 228 |

Footnote:
C.o.F = Co-efficient of Friction
Al = engine part commercially sold under trademark Alusil ®

The results above indicate that the product of the present invention is capable of reducing at least one of wear and friction compared to a reference lubricant containing ZDDP.

A series of SAE 80W-90 gear oil lubricants are prepared containing oleylamine, an overbased calcium sulphonate detergent, and further containing a source of phosphorus. The phosphorus is delivered by the product of the present invention. The phosphorus-containing additives for the lubricants prepared are summarised as follows:

| SAE 80W-90 Lubricant | Phosphorus Source | Phosphorus delivered (ppm) |
|---|---|---|
| CE3 | None | 306 |
| LUB7 | Prep8 | 290 |
| LUB8 | Prep10 | 309 |
| LUB9 | Prep12 | 317 |
| CE4 | None | 506 |
| LUB10 | Prep8 | 568 |
| LUB11 | Prep10 | 543 |
| LUB12 | Prep12 | 558 |

The SAE 80W-90 lubricants are evaluated for wear using a high frequency reciprocating rig (HFRR) available from PCS Instruments. HFRR conditions for the evaluations are 100 g load, 60 minute duration, 1000 micrometer stroke, 20 Hertz frequency, and run at an isothermal regime with a temperature of 100° C. The wear results obtained are presented in the following table:

| SAE 80W-90 Lubricant | Gear Oil Wear Scar (μm) |
|---|---|
| CE3 | 197 |
| LUB7 | 141 |
| LUB8 | 127 |
| LUB9 | 130 |
| CE4 | 165 |
| LUB10 | 141 |
| LUB11 | 131 |
| LUB12 | 136 |

The results above indicate that the product of the present invention is capable of reducing wear when utilized in a gear oil.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

As used here the term "alk(en)yl" includes alkyl and alkenyl.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method of lubricating a driveline device comprising supplying to the driveline device a lubricating composition comprising an oil of lubricating viscosity and 0.01 to 5 wt % of a product obtained/obtainable by reacting:

(i) a hydroxy-containing carboxylic compound, wherein the hydroxy-containing carboxylic compound is derived from glycolic acid, malic acid, tartaric acid, citric acid, or mixtures thereof, a (thio)phosphorylating agent, or reactive equivalents thereof, and optionally an alcohol, and optionally (ii) reacting the product of (i) with an amine, or mixtures thereof, wherein the driveline device includes a manual transmission that may or may not contain a synchronizer system, or an automatic transmission, or an axle.

2. The method of claim 1, wherein the product is present at 0.1 wt % to 1 wt of the lubricating composition.

3. The method of claim 1, wherein the product is present at 0.2 wt % to 0.5 wt % of the lubricating composition.

4. The method of claim 1, wherein the hydroxy-containing carboxylic compound is represented by the formulae:

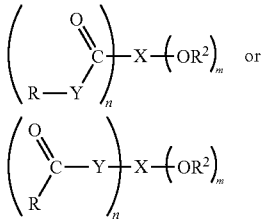

wherein n and m are independently integers of 1 to 5, wherein
- n and m both equal 1,
- n=2, m=1,
- n and m both equal 2, or
- n=3, m=1;

X is an aliphatic or alicyclic group, or an aliphatic or alicyclic group containing an oxygen atom in the carbon chain, or a substituted group of the foregoing types, said group containing up to 6 carbon atoms and having n+m available points of attachment;

each Y is independently —O—, >NH, or >$NR^1$ or two Ys together representing the nitrogen of an imide structure R—N< formed between two carbonyl groups; and each R and $R^1$ are independently hydrogen or a hydrocarbyl group, provided that at least one R or $R^1$ group is a hydrocarbyl group; each $R^2$ is independently hydrogen, a hydrocarbyl group or an acyl group, further provided that at least one —$OR^2$ group is located on a carbon atom within X that is α or β to at least one of the —C(O)—Y—R groups, and with the proviso that at least one $R^2$ group is hydrogen.

5. The method of claim 1, wherein the hydroxy-containing carboxylic compound is derived from tartaric acid or glycolic acid.

6. The method of claim 1, wherein the hydroxy-containing carboxylic compound is a partially esterified polyol, or mixtures thereof.

7. The method of claim 1, wherein the hydroxy-containing carboxylic compound is glycerol monooleate or glycerol dioleate.

8. The method of claim 1, wherein the (thio)phosphorylating agent, or reactive equivalents thereof is $POCl_3$, $P_2O_5$, $P_4O_{10}$, polyphosphoric acid, $P_2S_5$, or $P_4S_{10}$, or mixtures thereof.

9. The method of claim 1, wherein the (thio)phosphorylating agent, or reactive equivalents thereof is $POCl_3$, $P_2O_5$, $P_4O_{10}$, or polyphosphoric acid.

10. The method of claim 1, wherein the product is obtained/obtainable by reacting: (i) a hydroxy-containing carboxylic compound, a sulphur-free phosphating agent, optionally an alcohol, and optionally (ii) reacting the product of (i) with an amine, or mixtures thereof.

11. The method of claim 1, wherein the amine is a branched secondary or tertiary monoamine, or mixtures thereof.

12. The method of claim 1, wherein the alcohol is a monohydric alcohol and wherein the monohydric alcohol 8 to 15 carbon atoms.

13. The method of claim 1, wherein the alcohol is a branched alcohol containing 8 to 20 carbon atoms.

14. The method of claim 1, wherein the relative amounts of the hydroxy-containing carboxylic compound to the alcohol may be 1:0 to 0.2:0.8.

15. The method of claim 1, wherein the (thio)phosphorylating agent, or reactive equivalents thereof, is reacted with the hydroxy-containing carboxylic compound (and optionally the alcohol) in a ratio of 1 to 2.5 moles of hydroxyl groups per 1 mole of phosphorus from the (thio)phosphorylating agent, or reactive equivalents thereof.

* * * * *